US007043028B2

(12) United States Patent
Leske et al.

(10) Patent No.: US 7,043,028 B2
(45) Date of Patent: May 9, 2006

(54) METHOD AND SYSTEM FOR USING AN AUDIO TRANSDUCER AS BOTH AN INPUT AND OUTPUT DEVICE IN FULL DUPLEX OPERATION

(75) Inventors: Lawrence A. Leske, San Carlos, CA (US); David L. Medin, Los Altos, CA (US)

(73) Assignee: Tymphany Corporation, Cupertino, CA (US)

( * ) Notice: Subject to any disclaimer, the term of this patent is extended or adjusted under 35 U.S.C. 154(b) by 832 days.

(21) Appl. No.: 10/029,522

(22) Filed: Dec. 21, 2001

(65) Prior Publication Data

US 2003/0118201 A1 Jun. 26, 2003

(51) Int. Cl.
*H04R 29/00* (2006.01)
*H04R 3/00* (2006.01)

(52) U.S. Cl. ..... 381/59; 381/111; 381/58; 381/96

(58) Field of Classification Search ..... 381/111–117, 381/96, 57–59, 120, 83, 93; 700/94; 330/251, 330/207 A, 10

See application file for complete search history.

(56) References Cited

U.S. PATENT DOCUMENTS

| | | | | |
|---|---|---|---|---|
| 5,221,881 | A | 6/1993 | Cameron | |
| 5,285,135 | A | 2/1994 | Carobolante et al. | |
| 5,297,024 | A | 3/1994 | Carobolante | |
| 5,566,369 | A | 10/1996 | Carobolante | |
| 5,615,064 | A | 3/1997 | Blank et al. | |
| 5,838,515 | A | 11/1998 | Mortazavi et al. | |
| 5,869,946 | A | 2/1999 | Carobolante | |
| 6,081,112 | A | 6/2000 | Carobolante et al. | |
| 6,122,385 | A * | 9/2000 | Konno et al. | 381/96 |
| 2003/0118193 | A1 * | 6/2003 | Leske et al. | 381/59 |
| 2004/0161122 | A1 * | 8/2004 | Nielsen | 381/117 |

* cited by examiner

*Primary Examiner*—Laura A. Grier
(74) *Attorney, Agent, or Firm*—David N. Lathrop, Esq.; Gallagher & Lathrop

(57) ABSTRACT

A method and system for using an audio transducer as both an input device and an output device is disclosed. The method and system include digitally modulating a primary input signal for driving the transducer as an output device, sampling an output signal generated from the transducer during off times of the modulated signal, and determining an input signal from the sampled output signal.

17 Claims, 4 Drawing Sheets

METHOD AND SYSTEM FOR USING AN AUDIO TRANSDUCER AS BOTH AN INPUT AND OUTPUT DEVICE IN FULL DUPLEX OPERATION

FIELD OF THE INVENTION

The present invention relates generally to audio transducers and more particularly to an audio transducer as both an input and an output device in full duplex operations.

BACKGROUND OF THE INVENTION

Full duplex speakerphone telephone sets and intercoms are common devices. However, they require the use of two audio transducers, one as the speaker and the other as the microphone, for full duplex operation. It is also known that speakers can be utilized as both a speaker and a microphone in a speakerphone system. When speakers are used, however, they are utilized as microphones in a half duplex mode. In so doing, one communicator has to wait for the other to stop talking or there is significant distortion.

What is desired is to provide a speakerphone system where only one transducer is utilized but allows for full duplex operation. The system must be easy to implement, adaptable and compatible with existing speakers utilized in a speakerphone system. The system should not add significant cost to the speakerphone system. The present invention addresses such a need.

SUMMARY OF THE INVENTION

The present invention provides a method and system for using an audio transducer as both an input device and an output device. The method and system include digitally modulating a primary input signal for driving the transducer as an output device, sampling an output signal generated from the transducer during off times of the modulated signal, and determining an input signal from the sampled output signal.

In addition to the cost advantage of replacing the microphone with the existent loudspeaker (transducer), other benefits gained include: (1) the elimination of the acoustic feedback path from speaker to microphone, which would normally require additional circuitry to suppress the "howling" which could occur; (2) increased quality of audio as a result of the use of the speaker as the microphone instead of a usually more distorting separate microphone; (3) increased audio quality due to the better signal provided to echo canceling circuit from the speaker without having the significant echo directly from the speaker to microphone acoustic feedback path.

DETAILED DESCRIPTION

The present invention relates generally to audio transducers, and more particularly to an audio transducer as both an input and an output device in full duplex operations. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The present invention provides a full-duplex hands-free audio frequency circuit that uses a single transducer as both the microphone and loudspeaker for an intercom or telephone set, such as a voice over IP (VoIP) system. The audio frequency circuit simultaneously utilizes the single speaker both as an audio output device and as an input device, replacing the customary microphone. The audio frequency circuit is useful with any output power controller similar to a digital switching Class D or Class G amplifier that utilizes any form of digital pulse modulation.

Figure 1:
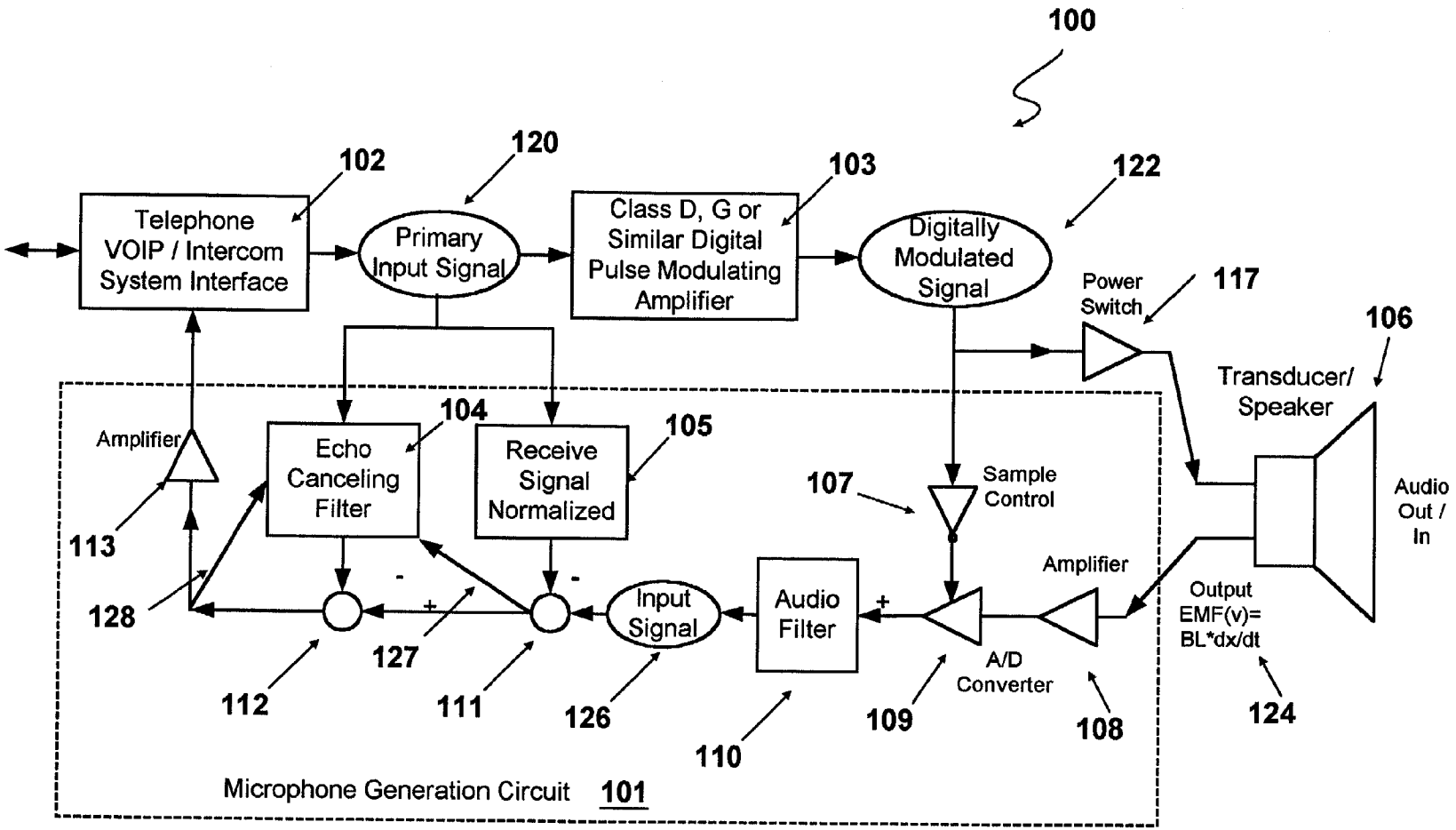
FIG. 1 is a block diagram illustrating a bi-directional audio frequency circuit for use in a speakerphone or intercom set in a preferred embodiment of the present invention.

FIG. 1 is a block diagram illustrating a bi-directional audio frequency circuit for use in a speakerphone or intercom set in a preferred embodiment of the present invention. The bi-directional audio frequency circuit 100 includes a telephone system interface 102, a digital pulse modulating amplifier 103, a modulating power switch 117, a transducer 106, and a microphone generation circuit 101 that allows the transducer 106 to operate as a microphone, while it is operating as a speaker in full duplex mode.

In operation, the telephone system interface 102 transmits a primary input signal 120 to the digital pulse modulating amplifier 103, such as a Class G, Class D, or similar amplifier, which produces a digitally modulated signal 122. As is well known in the art, a digitally modulated signal 122 continually transitions between two states: active and inverted. When the modulated signal 122 is active, the modulating power switch 117 switches on and drives the audio transducer 106 as a speaker (output device). When the modulated signal 122 is inverted, the power switch 117 switches off.

According to the present invention, during the power switch 117 off-times, the microphone generation circuit 101 uses the audio transducer 106 as an input device, as explained further below. In a preferred embodiment, the microphone generation circuit 101 accomplishes this function using an amplifier 108, sample control logic 107, A/D converter 109, audio filter 110, signal normalizer 105, echo canceling filter 104, and amplifier 113.

Figure 2:
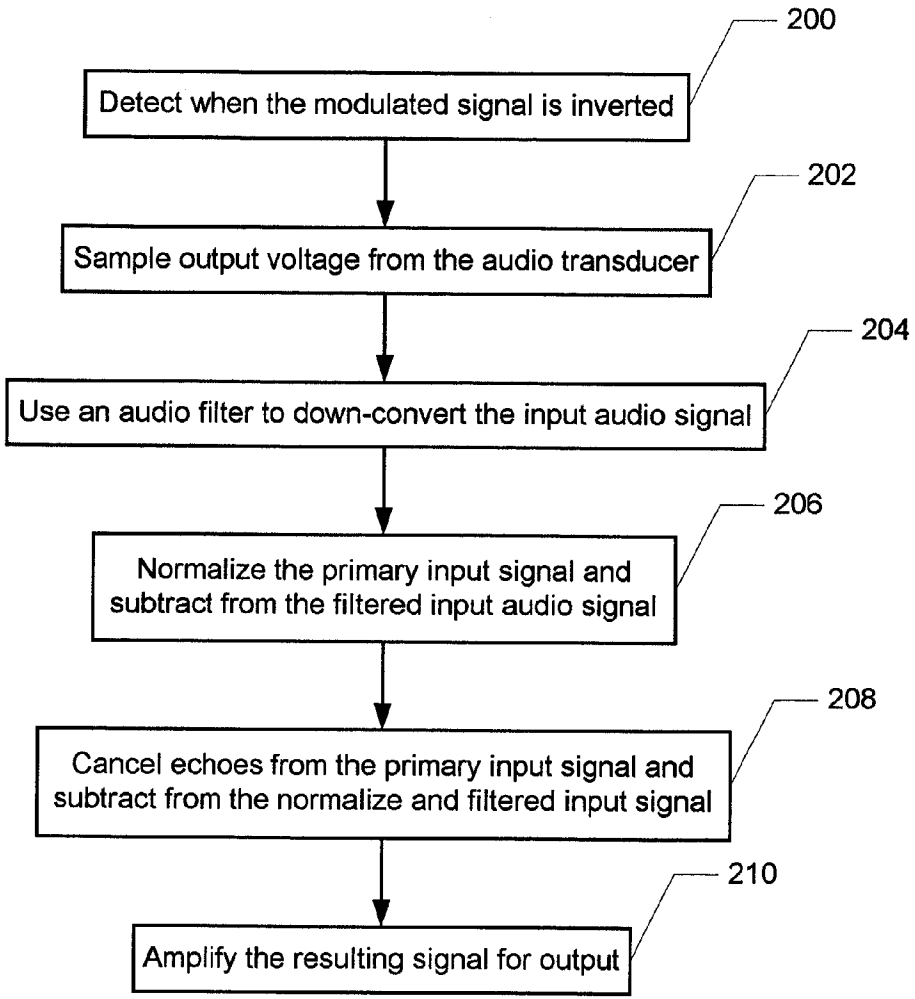
FIG. 2 is a flow chart illustrating the process for using the audio transducer as both an input and output device in full duplex operation according to a preferred embodiment of the present invention.

FIG. 2 is a flow chart illustrating the process for using the audio transducer as both an input and output device in full duplex operation according to a preferred embodiment of the present invention. The process begins in step 200 by detecting when the modulated signal 122 is inverted, and consequently also detects when the power switch 117 is not driving the audio transducer 106 (i.e., the off-times). In response, EMF output voltage 124 (or current) from the audio transducer 106 is sampled in step 202.

Figure 3:
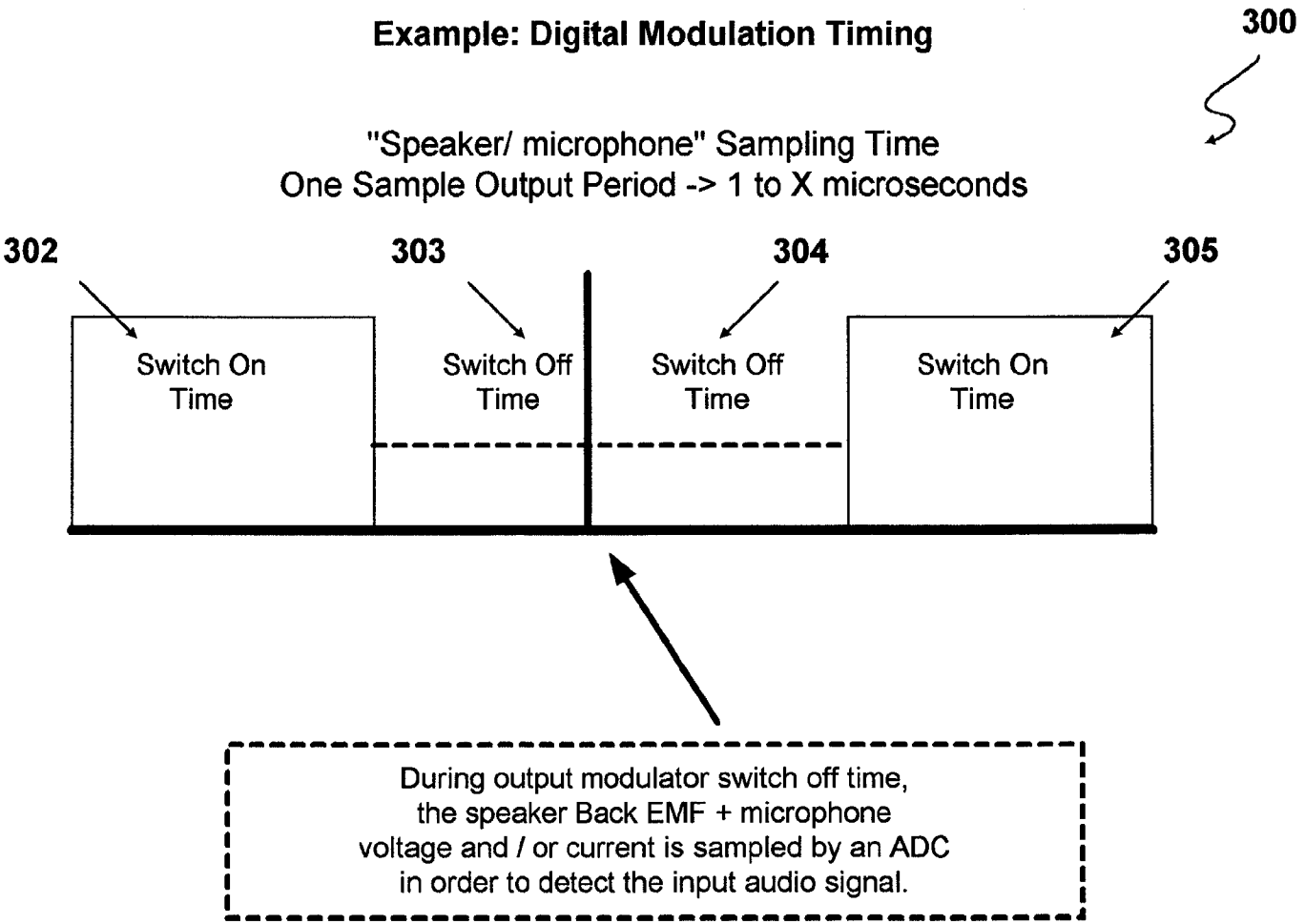
FIG. 3 is a diagram illustrating detail of the sampling time in which the audio transducer is used as a microphone.

FIG. 3 is a diagram illustrating detail of the sampling time 300 in which the audio transducer is used as a microphone. During power switch 117 on-times 302 and 305 of the digital modulated signal 122, the audio transducer 106 is used as an output speaker. Referring to both FIGS. 1 and 3, during power switch 117 off-times 303 and 304, the sample control logic 107 detects the inverted digitally modulated signal 122 and activates the A/D converter 109. The A/D converter 109 then samples the speaker back EMF output voltage 124 and/or current in order to detect an input audio signal 126 after the EMF output voltage 124 is amplified by amplifier 108.

The output voltage 124 input to the A/D converter 109 is a result of the motion of the transducer 106, both from sound being generated due to the drive signal, and from sound impinging from local audio sources, especially the voice of the local user. Referring again to FIG. 2, since the sampled input audio signal 126 will generally operate as a sample rate higher than the final audio sample rate need it, an audio filter 110 may be used to down-convert the input audio signal 126 and to minimize high frequency induced noise from the speaker drive circuitry in step 204.

When the modulated power switch 117 is active, the current injected into the transducer 106 by switch 117 generates a magnetic field in the transducer's coil, which acts with accelerative forces on the transducer 106. When the modulated power switch 117 is off, the transducer 106 continues to move due to inertia. When the transducer 106 is active as a speaker output device, the largest component of the signal from the transducer 106 is a result of the output from the modulating power switch 117, even when the digitally modulated signal 122 is inverted and the power switch 117 is off. As a result, whenever the transducer 106 is used as an input device (microphone), the effects of the modulating output signal must be removed from the sampled input audio signal 126 to prevent echoes. Failure to do this could result in highly disturbing echoes or "howling" from this feedback loop.

Referring again to FIG. 2, the present invention significantly reduces these effects in step 206 by using the signal normalizer 105 to normalize the primary input signal 120, and subtracting the normalized primary input signal 120 from the filtered input audio signal 126 at circuit 111 to create a clean version of the "microphone" input signal. This technique may also be used to minimize or eliminate locally generated sound, such as music or PC videogame sound effects, which would normally be played through the speaker. Thus, even though the user may clearly hear music playing, a remote communicator may not hear the music at all, or depending on the order of precision of the audio filter 110, may only hear the sounds at a very low nonintruding-level.

In order to additionally prevent room echoes from disturbing the conversation, an step 208 may optionally be performed in which the echo canceling filter 104 is used to cancel echoes from the primary input signal 120 and then the pseudo echo signal is subtracted from the normalized and filtered input signal 126 by circuit 112. Signals at 127 and 128 are training signals, used to adjust the filter coefficients for optimal echo cancellation. Echo canceling filters are well known in the art, see for example, U.S. Pat. No. 3,500,000. The resulting signal is then amplified as necessary by amplifier 113 for output to telephone system interface 102 in step 210.

Figure 4:
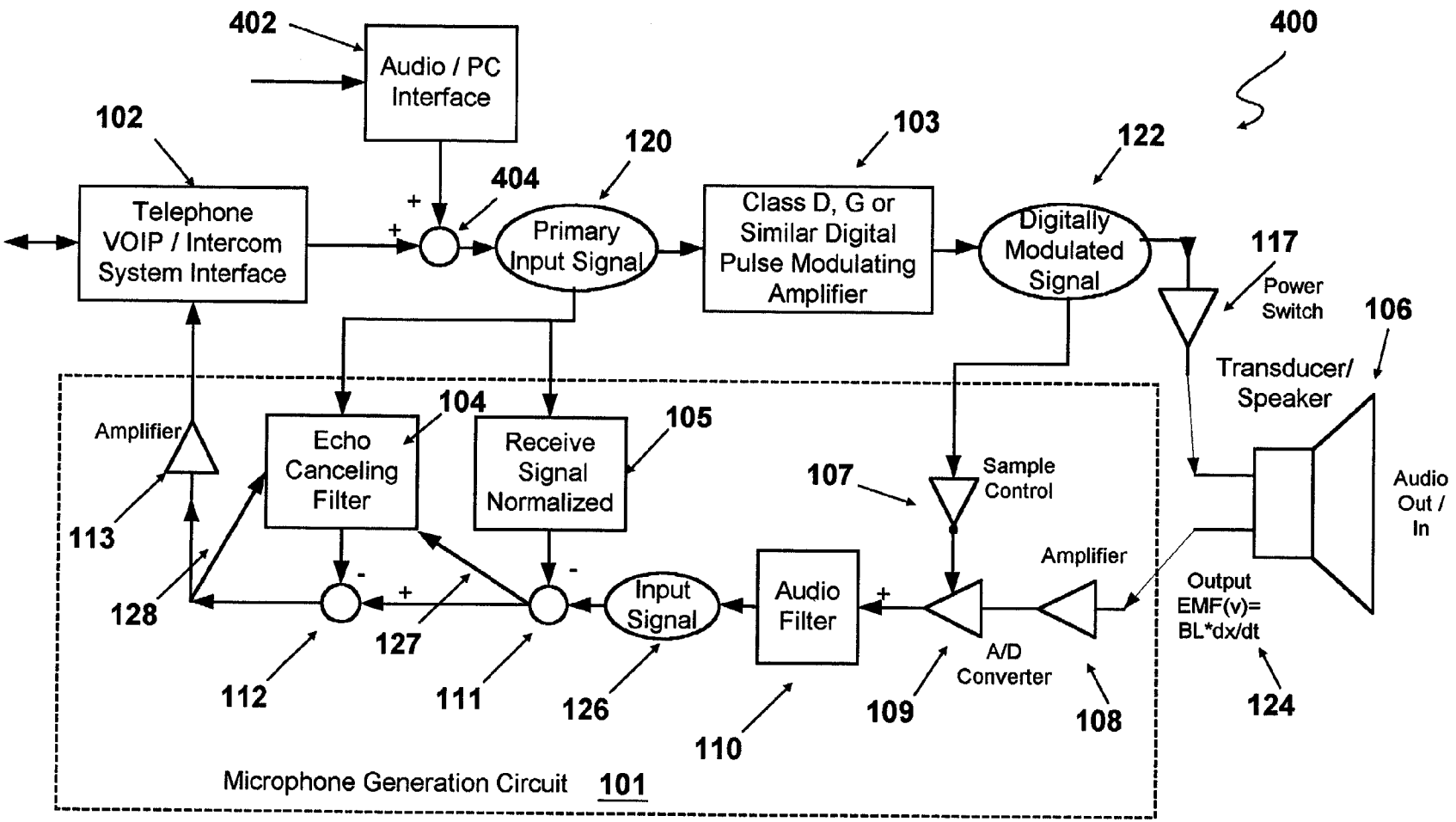
FIG. 4 is a block diagram illustrating a second preferred embodiment of the bi-directional audio controller.

FIG. 4 is a block diagram illustrating a second preferred embodiment of the bi-directional audio controller, where like components of FIG. 1 have like reference numerals. The second embodiment is identical to the first embodiment, but includes an audio/PC interface 402. In this circuit 400 any local audio source from the audio/PC interface 402 may be added to, or mixed with the primary input signal 120 at circuit 404. The mixed primary input signal 120 is then utilized by the digital modulator 103 for speaker output, as well as by the signal normalizer 105, and the echo canceller 104 to enable the removal of these unwanted signals from the microphone input signal 126.

Thus, this embodiment of the present invention provides the user with the ability to listen to a secondary input signal, such as PC audio or another caller, and have the echo canceller 104 subtract the secondary input signal from the microphone input, which effectively mutes the secondary input signal from the caller. The primary advantages are:

1) The ability for the user to listen to background music without the caller hearing the music;

2) In a conference call, two or more outside parties can be joined electronically (and digitally) as apposed to acoustically, which enables a) a cleaner connection and b) the ability to adjust volume of each party independently for each party; and 3) During a conference call, the outside parties can be selectively and individually muted by the user.

A method and system for using an audio transducer as both an input and output device in full duplex operation has been disclosed. Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for using an audio transducer as both an input device and an output device comprising:

(a) digitally modulating a primary input signal for driving the transducer as an output device;

(b) sampling an output signal generated from the transducer during off times of the modulated signal; and (c) determining an input signal from the sampled output signal by subtracting the primary input signal from the sampled output signal.

2. A method of using an audio transducer as both an input device and an output device, wherein the audio transducer is responsive to a modulated signal that transitions between active and inverted, such that the audio transducer acts as an output device when the modulated signal is active, the method comprising:

(a) detecting when the modulated signal is inverted;

(b) in response, sampling an output signal from the audio transducer in order to detect an input audio signal;

(c) filtering the sampled input audio signal: and;

(d) normalizing a primary input signal and subtracting the normalized primary input signal from the filtered input audio signal.

3. The method of claim 2 further including the step of: canceling echo from the normalized and filtered input audio signal.

4. The method of claim 2 further including the step of: providing an interface for mixing a secondary signal with the primary input signal.

5. The method of claim 2 wherein step (b) further includes the step of: amplifying an output signal.

6. The method of claim 5 wherein step (b) further includes the step of: using an A/D converter to sample the amplified output signal.

7. The method of claim 2 wherein step (a) further includes the step of: using sample control logic to detect the inverted modulated signal, and for activating an A/D converter that performs the sampling.

8. The method of claim 2 further including the step of: outputting the modulated signal from a digital pulse modulated amplifier to a power switch, wherein the power switch switches on when the modulated signal is active to drive the audio transducer as a speaker.

9. The method of claim 8 wherein step (b) further includes the step of: sampling the output signal from the audio transducer during power switch off-times.

10. The method of claim 9 further including the step of: during power switch off-times, using sample control logic to detect when the digitally modulated signal is inverted and activating an A/D converter to perform sampling.

11. A bi-directional audio frequency circuit, comprising:

an audio transducer;

a system interface for outputting a primary input signal;

a circuit for generating a digital pulse modulated signal from the primary input signal, wherein the digital pulse modulated signal transitions between active and inverted;

a power switch coupled to the audio transducer, the power switch having on-times when the digitally modulated signal is active and off-times when the digital pulse modulated signal is inverted, wherein the audio transducer is driven as an output device during power switch on-times; and microphone generation means coupled to the audio transducer for sampling output signal from the audio transducer during power switch off-times to detect an input audio signal;

means for filtering the sampled input audio signal; and means for normalizing the primary input signal and subtracting the normalized primary input signal from the filtered audio signal.

12. The circuit of claim 11 further including an echo canceling filter for canceling echo from output from the normalizing means.

13. The circuit of claim 12 wherein the microphone generation means further includes means for amplifying the output signal.

14. The circuit of claim 11 wherein the microphone generation means further includes sample control logic and an A/D converter, wherein the sample control logic detects the inverted digitally modulated signal and activates the A/D converter in response.

15. The circuit of claim 11 further including an interface for mixing a secondary signal with the primary input signal.

16. A method for using an audio transducer as both an input device and an output device comprising:

(a) digitally modulating a primary input signal for driving the transducer as an output device;

(b) sampling an output signal generated from the transducer during off times of the modulated signal; and (c) determining an input signal from the sampled output signal by subtracting the primary input signal and subtracting an echo canceling signal from the sampled output signal.

17. A method for using an audio transducer as both an input device and an output device comprising:

(a) providing an interface for mixing a secondary signal with the primary input signal to provide a mixed input signal;

(b) digitally modulating a mixed input signal for driving the transducer as an output device;

(c) sampling an output signal generated from the transducer during off times of the modulated signal; and (d) determining an input signal from the sampled output signal.

* * * * *